US012091630B2

(12) United States Patent
Yomogita

(10) Patent No.: US 12,091,630 B2
(45) Date of Patent: Sep. 17, 2024

(54) LUBRICANT OIL COMPOSITION, INTERNAL COMBUSTION ENGINE, AND METHOD FOR USING LUBRICANT OIL COMPOSITION

(71) Applicant: Idemitsu Kosan Co., Ltd., Chiyoda-ku (JP)

(72) Inventor: Akinori Yomogita, Tokyo (JP)

(73) Assignee: Idemitsu Kosan Co., Ltd., Chiyoda-ku (JP)

( * ) Notice: Subject to any disclaimer, the term of this patent is extended or adjusted under 35 U.S.C. 154(b) by 0 days.

(21) Appl. No.: 17/906,207

(22) PCT Filed: Mar. 12, 2021

(86) PCT No.: PCT/JP2021/010103
§ 371 (c)(1),
(2) Date: Sep. 13, 2022

(87) PCT Pub. No.: WO2021/187372
PCT Pub. Date: Sep. 23, 2021

(65) Prior Publication Data

US 2023/0122943 A1 Apr. 20, 2023

(30) Foreign Application Priority Data

Mar. 16, 2020 (JP) ..... 2020-045634

(51) Int. Cl.

| | |
|---|---|
| ***C10M 145/14*** | (2006.01) |
| ***C10M 101/00*** | (2006.01) |
| ***C10M 133/16*** | (2006.01) |
| ***C10M 169/04*** | (2006.01) |
| *C10N 10/06* | (2006.01) |
| *C10N 20/00* | (2006.01) |
| *C10N 20/02* | (2006.01) |
| *C10N 20/04* | (2006.01) |
| *C10N 30/00* | (2006.01) |
| *C10N 30/02* | (2006.01) |
| *C10N 30/04* | (2006.01) |
| *C10N 40/25* | (2006.01) |

(52) U.S. Cl.
CPC ..... *C10M 145/14* (2013.01); *C10M 101/00* (2013.01); *C10M 133/16* (2013.01); *C10M 169/04* (2013.01); *C10M 2205/163* (2013.01); *C10M 2209/084* (2013.01); *C10M 2215/086* (2013.01); *C10N 2010/06* (2013.01); *C10N 2020/02* (2013.01); *C10N 2020/04* (2013.01); *C10N 2020/071* (2020.05); *C10N 2020/073* (2020.05); *C10N 2030/02* (2013.01); *C10N 2030/04* (2013.01); *C10N 2030/45* (2020.05); *C10N 2030/54* (2020.05); *C10N 2040/252* (2020.05); *C10N 2040/255* (2020.05)

(58) Field of Classification Search
CPC ..... C10M 145/14; C10M 101/00; C10M 133/16; C10M 169/04; C10M 2205/163; C10M 2209/084; C10M 2215/086; C10M 2203/1025; C10M 2207/262; C10M 2207/289; C10M 2215/064; C10M 2215/28; C10M 2223/045; C10M 157/00; C10N 2010/06; C10N 2020/02; C10N 2020/04; C10N 2020/071; C10N 2020/073; C10N 2030/02; C10N 2030/04; C10N 2030/45; C10N 2030/54; C10N 2040/252; C10N 2040/255; C10N 2030/40; C10N 2030/52; C10N 2030/68; C10N 2040/25
See application file for complete search history.

(56) References Cited

U.S. PATENT DOCUMENTS

| | | | | |
|---|---|---|---|---|
| 2005/0003974 | A1* | 1/2005 | Briggs | C10M 143/12 508/591 |
| 2013/0030226 | A1 | 1/2013 | Teshima et al. | |
| 2017/0088789 | A1 | 3/2017 | Grisso et al. | |
| 2017/0298287 | A1 | 10/2017 | Tamura | |
| 2021/0032559 | A1 | 2/2021 | Sunahara et al. | |

FOREIGN PATENT DOCUMENTS

| | | | | |
|---|---|---|---|---|
| CA | 2693461 | A1 * | 1/2009 | C08F 255/00 |
| CN | 107075405 | A | 8/2017 | |
| CN | 108699473 | A | 10/2018 | |
| JP | 2017-508053 | A | 3/2017 | |
| JP | 2019-94473 | A | 6/2019 | |
| JP | 2019-178296 | A | 10/2019 | |
| WO | WO 2011/125881 | A1 | 10/2011 | |
| WO | WO 2016/043333 | A1 | 3/2016 | |

OTHER PUBLICATIONS

International Search Report mailed on Jun. 8, 2021 in PCT/JP2021/010103 filed on Mar. 12, 2021 (2 pages).
Combined Chinese Office Action and Search Report issued Nov. 24, 2023 in Chinese Patent Application No. 202180021300.6 (with unedited computer-generated English Translation of Office Action only), 16 pages.

* cited by examiner

*Primary Examiner* — Cephia D Toomer
(74) *Attorney, Agent, or Firm* — Oblon, McClelland, Maier & Neustadt, L.L.P.

(57) ABSTRACT

A lubricating oil composition containing a base oil (A), a comb-shaped polymer (B), and an olefin-based copolymer (C), wherein a content of the component (B) is more than 0.80 mass % based on the total amount of the lubricating oil composition, a weight average molecular weight of the component (C) is 500,000 or more, and the lubricating oil composition has a viscosity index of 200 or more and a kinematic viscosity at 100° C. of 9.3 to 11.0 $mm^2/s$.

20 Claims, No Drawings

LUBRICANT OIL COMPOSITION, INTERNAL COMBUSTION ENGINE, AND METHOD FOR USING LUBRICANT OIL COMPOSITION

CROSS REFERENCE TO RELATED APPLICATIONS

This application is a National Stage entry under 35 U.S.C. § 371 of PCT/JP2021/010103, filed on Mar. 12, 2021, and claims priority to Japanese Patent Application No. 2020-045634, filed on Mar. 16, 2020. The entire contents of both are incorporated herein by reference.

TECHNICAL FIELD

The present invention relates to a lubricating oil composition, an internal combustion engine applied with the lubricating oil composition, and a method for using the lubricating oil composition.

BACKGROUND ART

Engine oils used in internal combustion engines such as diesel engines and gasoline engines are desired to have fuel-saving performance, and thus the lowering of the viscosity of engine oils has proceeded. However, an engine oil having a low viscosity has a problem of being easily formed into mist. The mist floating inside the internal combustion engine affects the accumulation of deposit on the piston surface and the amount of consumption of engine oils.

To address such a problem, various examinations have been made with respect to the engine oil having a low viscosity in which the effect of suppressing mist formation is improved.

For example, to provide a lubricating oil composition for internal combustion engines that is excellent in an effect of suppressing mist formation and coking resistance, and further excellent in fuel-saving performance, Patent Literature 1 discloses a lubricating oil composition for internal combustion engines obtained by compounding a polyisobutylene with a mixed base oil of a poly a olefin having a predetermined kinematic viscosity, CCS viscosity and NOACK value and a mineral oil having a predetermined viscosity index.

CITATION LIST

Patent Literature

Patent Literature 1: WO2011/125881

SUMMARY OF INVENTION

Technical Problem

Under such circumstances, a new lubricating oil composition that is preferably applicable to lubrication of the internal combustion engine has been desired.

Solution to Problem

The present invention provides a lubricating oil composition containing a base oil, a comb-shaped polymer, and an olefin-based copolymer, wherein the content of the comb-shaped polymer and the weight average molecular weight of the olefin-based copolymer is adjusted to a predetermined range, and the lubricating oil composition is adjusted to have a predetermined viscosity index and kinematic viscosity.

Specific embodiments of the present invention are as described in the following [1] to [13].

[1] A lubricating oil composition comprising a base oil (A), a comb-shaped polymer (B), and an olefin-based copolymer (C), wherein a content of the component (B) is more than 0.80 mass % based on the total amount of the lubricating oil composition, a weight average molecular weight of the component (C) is 500,000 or more, and the lubricating oil composition has a viscosity index of 200 or more and a kinematic viscosity at 100° C. of 9.3 to 11.0 $mm^2/s$.

[2] The lubricating oil composition according to the above [1], wherein a content ratio [(C)/(B)] of the component (C) to the component (B) by mass is 0.90 or less.

[3] The lubricating oil composition according to the above [1] or [2], wherein a weight average molecular weight of the component (B) is 200,000 or more.

[4] The lubricating oil composition according to any one of the above [1] to [3], wherein a content of the component (C) is 0.10 to 2.00 mass % based on the total amount of the lubricating oil composition.

[5] The lubricating oil composition according to any one of the above [1] to [4], wherein the component (C) contains a star-shaped polymer (C1).

[6] The lubricating oil composition according to any one of the above [1] to [5], wherein the total content of the component (B) and the component (C) is 0.90 to 8.00 mass % based on the total amount of the lubricating oil composition.

[7] The lubricating oil composition according to any one of the above [1] to [6], further comprising an ashless dispersant (D) containing at least one selected from a succinimide and a boron-modified product of succinimide.

[8] The lubricating oil composition according to any one of the above [1] to [7], wherein a content of a polymethacrylate-based viscosity index improver is less than 10 parts by mass based on the total amount of the components (B) and (C) of 100 parts by mass.

[9] The lubricating oil composition according to any one of the above [1] to [8], wherein an SAE viscosity grade of the lubricating oil composition is 0W-30 or 5W-30.

[10] The lubricating oil composition according to any one of the above [1] to [9], wherein a 100° C. kinematic viscosity of the lubricating oil composition after being subjected to ultrasonic irradiation for 30 minutes in accordance with a low output method of JPI-5S-29 is 9.3 $mm^2/s$ or more.

The lubricating oil composition according to any one of the above [1] to [10], wherein the lubricating oil composition is used for lubrication of an internal combustion engine.

An internal combustion engine applied with the lubricating oil composition according to any one of the above [1] to [11].

A method for using the lubricating oil composition, wherein the lubricating oil composition according to any one of the above [1] to [11] is applied to lubrication of an internal combustion engine.

Advantageous Effects of Invention

The lubricating oil composition of one preferred embodiment of the present invention is excellent in at least one of fuel-saving performance, shear stability, and effect of suppressing mist formation, and the lubricating oil composition of a more preferred embodiment of the present invention is excellent in fuel-saving performance, shear stability, and effect of suppressing mist formation. Thus, these lubricating oil compositions of the embodiments of the present invention are preferably applicable to lubrication of the internal combustion engine.

DESCRIPTION OF EMBODIMENTS

In the present specification, a kinematic viscosity and a viscosity index mean values measured and calculated in accordance with JIS K2283:2000.

In the present specification, the weight average molecular weight (Mw) and the number average molecular weight (Mn) are values in terms of standard polystyrene measured by gel permeation chromatography (GPC), and specifically mean values measured by the method described in Examples.

[Constitution of Lubricating Oil Composition]

The lubricating oil composition of the present invention contains a base oil (A), a comb-shaped polymer (B), and an olefin-based copolymer (C), has a viscosity index of 200 or more, and has a kinematic viscosity at 100° C. adjusted to 9.3 to 11.0 $mm^2/s$.

The viscosity index and kinematic viscosity of the lubricating oil composition of the present invention are mainly adjusted by using the component (B) and the component (C) which are polymer components in combination.

Since the viscosity index of the lubricating oil composition of the present invention is adjusted to 200 or more, the viscosity change due to the temperature change is small, so that a lubricating oil composition that is excellent in fuel-saving performance can be obtained.

From the viewpoint of obtaining a lubricating oil composition in which the viscosity change due to the temperature change is small and which is excellent in fuel-saving performance, the viscosity index of the lubricating oil composition of one embodiment of the present invention is preferably 205 or more, more preferably 208 or more, still more preferably 210 or more, and still much more preferably 214 or more.

The lubricating oil composition of the present invention has a kinematic viscosity at 100° C. of 9.3 to 11.0 $mm^2/s$. Thus, the SAE viscosity grade of the lubricating oil composition of the present invention corresponds to 0W-30 or 5W-30.

In general, a lubricating oil composition having a low viscosity has favorable fuel-saving performance, but is easily formed into mist. For example, floating of mist inside the internal combustion engine becomes a factor of causing adverse effects such as an increase in the accumulation of deposit on the piston surface and an increase in the amount of consumption of the lubricating oil composition. To solve such problems, in the lubricating oil composition of the present invention, the effect of suppressing mist formation is improved by containing a predetermined amount of the comb-shaped polymer (B) as the polymer component.

On the other hand, it has been found that compounding the component (B) may cause a problem of the decrease in shear stability. To solve this problem of the decrease in shear stability, the lubricating oil composition of the present invention contains the olefin-based copolymer (C) having a predetermined weight average molecular weight together with the component (B) as the polymer components, resulting in a lubricating oil composition having an improved effect of suppressing mist formation and further having favorable shear stability.

In the lubricating oil composition of one embodiment of the present invention, from the viewpoint of obtaining a lubricating oil composition having a further improved effect of suppressing mist formation, the content ratio [(C)/(B)] of the component (C) to the component (B) by mass is preferably 0.90 or less, more preferably 0.85 or less, still more preferably 0.80 or less, still much more preferably 0.70 or less, or further may be 0.65 or less, 0.60 or less, 0.55 or less, 0.50 or less, 0.45 or less, 0.40 or less, or 0.35 or less, and from the viewpoint of obtaining a lubricating oil composition having further improved shear stability, it is preferably 0.05 or more, more preferably 0.10 or more, still more preferably 0.15 or more, still much more preferably 0.20 or more, or further may be 0.23 or more, 0.25 or more, 0.27 or more, or 0.30 or more.

That is to say, from the aforementioned viewpoints, the content ratio [(C)/(B)] of the component (C) to the component (B) by mass is preferably 0.05 to 0.90, more preferably 0.10 to 0.85, still more preferably 0.15 to 0.80, and still much more preferably 0.20 to 0.70.

In the lubricating oil composition of one embodiment of the present invention, from the viewpoint of adjusting the viscosity index and kinematic viscosity of the lubricating oil composition in the aforementioned range, the total content of the component (B) and the component (C) is preferably 0.90 to 8.00 mass %, more preferably 1.10 to 6.00 mass %, still more preferably 1.30 to 5.00 mass %, still much more preferably 1.50 to 4.00 mass %, and particularly preferably 1.70 to 3.00 mass %, based on the total amount (100 mass %) of the lubricating oil composition.

Considering the handleability and the solubility with the component (A), the components (B) and (C) are often commercially available in a form of a solution dissolved in a diluent oil.

In the present specification, each content of the components (B) and (C) is, in a solution diluted with a diluent oil, a content in terms of resin content constituting the components (B) and (C), excluding the mass of the diluent oil.

The lubricating oil composition of one embodiment of the present invention preferably further contains at least one selected from an ashless dispersant (D), a metal-based detergent (E), an antioxidant (F), and an anti-wear agent (G).

The lubricating oil composition of one embodiment of the present invention may further contain lubricating oil additives other than the components (B) to (G) when needed as long as the effects of the present invention are not impaired.

In the lubricating oil composition of one embodiment of the present invention, the total content of the components (A), (B) and (C) is preferably 50 mass % or more, more preferably 55 mass % or more, still more preferably 60 mass % or more, still much more preferably 65 mass % or more, and particularly preferably 70 mass % or more, or further may be 72 mass % or more or 75 mass % or more, based on the total amount (100 mass %) of the lubricating oil composition.

In the lubricating oil composition of one embodiment of the present invention, the total content of the components (A), (B), (C), (D), (E), (F), and (G) is preferably 60 mass % or more, more preferably 65 mass % or more, still more preferably 70 mass % or more, still much more preferably 75 mass % or more, particularly preferably 80 mass % or more, or further may be 82 mass % or more, 85 mass % or more, 87 mass % or more, or 90 mass % or more, based on the total amount (100 mass %) of the lubricating oil composition.

Hereinafter, details of each component contained in the lubricating oil composition of one embodiment of the present invention will be described.

<Component (A): Base Oil>

As the base oil which is the component (A) used in one embodiment of the present invention, one or more selected from mineral oils and synthetic oils can be mentioned.

Examples of the mineral oils include atmospheric residues obtained by subjecting crude oils, such as paraffinic crude oil, intermediate base crude oil and naphthenic crude oil, to atmospheric distillation; distillates obtained by subjecting these atmospheric residues to vacuum distillation; and refined oils obtained by subjecting the distillates to one or more of refining treatments, such as solvent deasphalting, solvent extraction, hydrocracking, solvent dewaxing, catalytic dewaxing, and hydrorefining.

Examples of the synthetic oils include poly-α-olefins, such as an α-olefin homopolymer and an α-olefin copolymer (for example, an α-olefin copolymer having 8 to 14 carbon atoms such as an ethylene-α-olefin copolymer); isoparaffin; polyalkylene glycol; ester oils, such as polyol ester, dibasic acid ester, and phosphoric acid ester; ether oils, such as polyphenyl ether;

alkylbenzene; alkylnaphthalene; and synthetic oil (GTL) obtained by isomerizing wax (GTL WAX (Gas To Liquids WAX)) produced from natural gas through Fischer-Tropsch process or the like.

Among these, it is preferable to contain one or more selected from mineral oils classified in Group II and Group III of API (American Petroleum Institute) base oil categories, and synthetic oils, as the component (A) used in one embodiment of the present invention.

The kinematic viscosity of the component (A) used in one embodiment of the present invention at 100° C. is preferably 2.0 to 20.0 $mm^2/s$, more preferably 2.0 to 15.0 $mm^2/s$, still more preferably 3.0 to 12.0 $mm^2/s$, still much more preferably 3.2 to 9.0 $mm^2/s$, and particularly preferably 3.5 to 7.0 $mm^2/s$.

The viscosity index of the component (A) used in one embodiment of the present invention is appropriately set depending on the applications of the lubricating oil composition, and is preferably 70 or more, more preferably 80 or more, still more preferably 90 or more, still much more preferably 100 or more, and particularly preferably 110 or more.

When a mixed oil that is a combination of two or more base oils is used as the component (A) in one embodiment of the present invention, the kinematic viscosity and the viscosity index of the mixed oil are preferably in the above ranges.

In the lubricating oil composition of one embodiment of the present invention, the content of the component (A) is preferably 30 to 99.0 mass %, more preferably 40 to 98.5 mass %, still more preferably 50 to 98.0 mass %, still much more preferably 60 to 97.0 mass %, and particularly preferably 65 to 95.0 mass %, based on the total amount (100 mass %) of the lubricating oil composition.

The content of the component (A) further may be 67 mass % or more, 70 mass % or more, or 72 mass % or more, and 93.0 mass % or less, 90.0 mass % or less, 87.0 mass % or less, 85.0 mass % or less, 83.0 mass % or less, or 80.0 mass % or less, based on the total amount (100 mass %) of the lubricating oil composition.

<Component (B): Comb-Shaped Polymer>

The comb-shaped polymer which is the component (B) used in one embodiment of the present invention is only required to be a polymer having a structure including a large number of three-way branch points from which a side chain having a high-molecular weight comes out, in the main chain.

In the lubricating oil composition of the present invention, the viscosity index of the lubricating oil composition is adjusted by containing the component (B), so that the fuel-saving performance is improved and the effect of suppressing mist formation is also improved.

From the viewpoint of obtaining a lubricating oil composition that is excellent in fuel-saving performance while having a further improved effect of suppressing mist formation, in the lubricating oil composition of the present invention, the content of the component (B) is more than 0.80 mass %, and is preferably 0.85 mass % or more, more preferably 0.88 mass % or more, still more preferably 1.00 mass % or more, still much more preferably 1.20 mass % or more, particularly preferably 1.35 mass % or more, or further may be 1.40 mass % or more, 1.45 mass % or more, 1.47 mass % or more, or 1.50 mass % or more, and is preferably 6.00 mass % or less, more preferably 5.00 mass % or less, more preferably 4.00 mass % or less, still more preferably 3.50 mass % or less, still much more preferably 3.00 mass % or less, particularly preferably 2.50 mass % or less, or further may be 2.20 mass % or less, 2.00 mass % or less, 1.90 mass % or less, 1.80 mass % or less, or 1.70 mass % or less, based on the total amount (100 mass %) of the lubricating oil composition.

That is to say, in the lubricating oil composition of the present invention, the content of the component (B) is preferably more than 0.80 mass % and 6.00 mass % or less, more preferably 0.85 to 5.00 mass %, more preferably 0.88 to 4.00 mass %, still more preferably 1.00 to 3.50 mass %, still much more preferably 1.20 to 3.00 mass %, and particularly preferably 1.35 to 2.50 mass %, based on the total amount (100 mass %) of the lubricating oil composition.

From the viewpoint of obtaining a lubricating oil composition excellent in fuel-saving performance while having a further improved effect of suppressing mist formation, the weight average molecular weight (Mw) of the component (B) used in one embodiment of the present invention is preferably 200,000 or more, more preferably 250,000 or more, still more preferably 300,000 or more, still much more preferably 350,000 or more, particularly preferably 450,000 or more, or further may be 500,000 or more, 550,000 or more, or 600,000 or more, and is preferably 1,000,000 or less, more preferably 900,000 or less, still more preferably 800,000 or less, still much more preferably 750,000 or less, and particularly preferably 700,000 or less.

That is to say, the weight average molecular weight (Mw) of the component (B) is preferably 200,000 to 1,000,000, more preferably 250,000 to 900,000, still more preferably 300,000 to 800,000, still much more preferably 350,000 to 750,000, and particularly preferably 450,000 to 700,000.

From the viewpoint of obtaining a lubricating oil composition having further improved effect of suppressing mist formation, the molecular weight distribution (Mw/Mn) of the component (B) used in one embodiment of the present invention (wherein Mn represents the number average molecular weight of the component (B)) is preferably 8.00 or less, more preferably 7.00 or less, still more preferably 6.00 or less, still much more preferably 4.00 or less, and particularly preferably 3.00 or less, further may be 2.80 or less, 2.60 or less, 2.50 or less, or 2.40 or less, and preferably 1.01 or more, more preferably 1.02 or more, still more preferably 1.05 or more, still much more preferably 1.07 or more, and particularly preferably 1.10 or more.

That is to say, the molecular weight distribution (Mw/Mn) of the component (B) is preferably 1.01 to 8.00, more preferably 1.02 to 7.00, still more preferably 1.05 to 6.00, still much more preferably 1.07 to 4.00, and particularly preferably 1.10 to 3.00.

From the viewpoint of obtaining a lubricating oil composition having further improved effect of suppressing mist formation, SSI (shear stability index) of the component (B) used in one embodiment of the present invention is preferably 100 or less, more preferably 80 or less, still more preferably 70 or less, still much more preferably 60 or less, and particularly preferably 50 or less.

The lower limit value of SSI of the component (B) is not particularly limited, and is usually 0.1 or more.

In the present specification, SSI (shear stability index) represents a decrease in viscosity caused by shear derived from the polymer component by percentage, and is a value measured in accordance with JPI-5S-29-06, more specifically, a value calculated by the following expression (1).

$$SSI(\%)=(Kv_0-Kv_1)/(Kv_0-K_{voil})\times 100 \quad \text{Expression (1)}$$

In the above expression (1), $Kv_0$ is a value of the kinematic viscosity of a sample oil at 100° C. in which the polymer component is diluted in a mineral oil, and $Kv_1$ is a value of the kinematic viscosity of the sample oil at 100° C. in which the polymer component is diluted in a mineral oil, after being subjected to irradiation with ultrasonic wave for 30 minutes by an output method in accordance with the procedures of JPI-5S-29-06. Moreover, $Kv_{oil}$ is a value of the kinematic viscosity of the mineral oil at 100° C. used when the polymer component is diluted.

The value of SSI of the component (B) varies with the structure of the comb-shaped polymer. Specifically, there are following tendencies, and by considering these matters, the value of SSI of the component (B) can be easily adjusted. The following matters are merely examples, and the value of SSI of the component (F1) can also be adjusted by considering matters other than these matters.

A comb-shaped polymer whose side chain is constituted of the macromonomer (x1) and in which the content of the structural unit (X1) derived from the macromonomer (x1) is 0.5 mol % or more, based on the total amount (100 mol %) of the structural unit tends to have a low value of SSI.

As the molecular weight of the macromonomer (x1) constituting the side chain of the comb-shaped polymer becomes higher, the value of SSI tends to become lower.

The component (B) used in one embodiment of the present invention is preferably a polymer at least having a structural unit (X1) derived from a macromonomer (x1). This structural unit (X1) corresponds to the aforementioned "side chain having a high-molecular weight".

In the present invention, the above "macromonomer (x1)" means a high-molecular weight monomer having a polymerizable functional group, and is preferably a high-molecular weight monomer having a polymerizable functional group at a terminal thereof.

In the component (B) used in one embodiment of the present invention, the content of the structural unit (X1) is preferably 0.5 to 20 mol %, more preferably 0.7 to 10 mol %, and still more preferably 0.9 to 5 mol %, based on the total amount (100 mol %) of the structural unit of the component (B).

In the present specification, the content of each structural unit in the component (B) and the component (C) means a value calculated by analyzing the $^{13}C$-NMR quantitative spectrum.

The number average molecular weight (Mn) of the macromonomer (x1) is preferably 300 or more, more preferably 400 or more, still more preferably 500 or more, and preferably 100,000 or less, more preferably 50,000 or less, still more preferably 20,000 or less.

That is to say, the number average molecular weight (Mn) of the macromonomer (x1) is preferably 300 to 100,000, more preferably 400 to 50,000, and still more preferably 500 to 20,000.

Examples of the polymerizable functional group included in the macromonomer (x1) include an acryloyl group ($CH_2$═CH—COO—), a methacryloyl group ($CH_2$═$CCH_3$—COO—) an ethenyl group ($CH_2$═CH—), a vinyl ether group ($CH_2$═CH—O—), an allyl group ($CH_2$═CH—$CH_2$—), an allyl ether group ($CH_2$═CH—$CH_2$—O—), a group represented by $CH_2$═CH—CONH—, and a group represented by $CH_2$═$CCH_3$—CONH—.

In addition to the above polymerizable functional group, the macromonomer (x1) may have, for example, one or more repeating units represented by the following general formulae (i) to (iii).

(i)

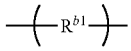

(ii)

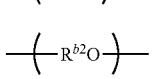

(iii)

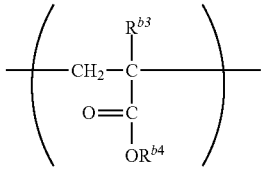

In the above general formula (i), $R^{b2}$ is a linear or branched alkylene group having 1 to 10 carbon atoms.

In the general formula (ii), $R^{b2}$ is a linear or branched alkylene group having 2 to 4 carbon atoms.

In the general formula (iii), $R^{b3}$ is a hydrogen atom or a methyl group. $R^{b4}$ is a linear or branched alkyl group having 1 to 10 carbon atoms.

When the macromonomer (x1) has a plurality of repeating units represented by each of the above general formulae (i) to (iii), $R^{b2}$, $R^{b2}$, $R^{b3}$ and $R^{b4}$ may be each the same as one another or may be different from one another.

In one embodiment of the present invention, the macromonomer (x1) is preferably a polymer having a repeating unit represented by the general formula (i), and more preferably a polymer having a repeating unit (X1-1) in which $R^{b1}$ in the general formula (i) is at least one selected from a 1,2-butylene group and a 1,4-butylene group.

The content of the repeating unit (X1-1) is preferably 1 to 100 mol %, more preferably 20 to 95 mol %, still more preferably 40 to 90 mol %, and still much more preferably 50 to 80 mol %, based on the total amount (100 mol %) of the structural unit of the macromonomer (x1).

When the macromonomer (x1) is a copolymer having two or more repeating units selected from the general formulae (i) to (iii), the form of copolymerization may be a block copolymer or may be a random copolymer.

The component (B) used in one embodiment of the present invention may be a homopolymer consisting only of a structural unit (X1) derived from one macromonomer (x1), or may be a copolymer having a structural unit (X1) derived from two or more macromonomers (x1).

The component (B) used in one embodiment of the present invention may be a copolymer having a structural unit (X2) derived from a monomer other than the macromonomer (x1) together with a structural unit (X1) derived from a macromonomer (x1).

As a specific structure of such a comb-shaped polymer, a copolymer having a side chain including the structural unit (X1) derived from the macromonomer (x1) relative to the main chain including the structural unit (X2) derived from the monomer (x2) is preferable.

Examples of the monomer (x2) include alkyl (meth) acrylate, a nitrogen atom-containing vinyl monomer, a hydroxyl group-containing vinyl monomer, a phosphorus atom-containing monomer, an aliphatic hydrocarbon-based vinyl monomer, a cycloaliphatic hydrocarbon-based vinyl monomer, vinyl ester, vinyl ether, vinyl ketone, an epoxy group-containing vinyl monomer, a halogen element-containing vinyl monomer, an ester of unsaturated polycarboxylic acid, (di)alkyl fumarate, (di)alkyl maleate, and an aromatic hydrocarbon-based vinyl monomer.

The monomer (x2) is preferably a monomer other than the phosphorus atom-containing monomer and the aromatic hydrocarbon-based vinyl monomer, more preferably includes one or more selected from a monomer represented by the following general formula (al), alkyl(meth)acrylate, and a hydroxyl group-containing vinyl monomer, and still more preferably includes at least a hydroxyl group-containing vinyl monomer (x2-d).

(al)

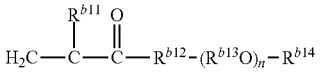

In the general formula (al), $R^{b11}$ is a hydrogen atom or a methyl group.

$R^{b12}$ is a single bond, a linear or branched alkylene group having 1 to 10 carbon atoms, —O—, or —NH—.

$R^{b13}$ is a linear or branched alkylene group having 2 to 4 carbon atoms. Moreover, n represents an integer of 1 or more (preferably an integer of 1 to 20, and more preferably an integer of 1 to 5). When n is an integer of 2 or more, each $R^{b13}$ may be the same as one another or may be different from one another, and further, the $(R^{b13}O)_n$ moiety may be a random bond or a block bond.

$R^{b14}$ is a linear or branched alkyl group having 1 to 60 (preferably 10 to 50, and more preferably 20 to 40) carbon atoms.

<Component (C): Olefin-Based Copolymer>

The lubricating oil composition of the present invention contains an olefin-based copolymer having a weight average molecular weight (Mw) of 500,000 or more as the component (C). The lubricating oil composition of the present invention containing the olefin-based copolymer having a weight average molecular weight (Mw) of 500,000 or more has the viscosity index of the lubricating oil composition adjusted so that the fuel-saving performance is improved, and also has improved shear stability while having a favorable effect of suppressing mist formation.

From the viewpoint of obtaining a lubricating oil composition that is excellent in fuel-saving performance and has improved shear stability while having a favorable effect of suppressing mist formation, the weight average molecular weight (Mw) of the component (C) used in one embodiment of the present invention is 500,000 or more, preferably 520,000 or more, more preferably 550,000 or more, still more preferably 570,000 or more, and preferably 1,000,000 or less, more preferably 900,000 or less, still more preferably 800,000 or less, still much more preferably 750,000 or less, or further may be 700,000 or less, or 650,000 or less.

That is to say, the weight average molecular weight (Mw) of the component (C) is preferably 500,000 to 1,000,000, more preferably 520,000 to 900,000, still more preferably 550,000 to 800,000, and still much more preferably 570,000 to 750,000.

From the viewpoint of obtaining a lubricating oil composition that is excellent in fuel-saving performance and has further improved shear stability while having a favorable effect of suppressing mist formation, the molecular weight distribution (Mw/Mn) of the component (C) used in one embodiment of the present invention (wherein Mn represents the number average molecular weight of the component (C)) is preferably 8.00 or less, more preferably 7.00 or less, still more preferably 6.00 or less, still much more preferably 3.00 or less, particularly preferably 2.00 or less, or further may be 1.80 or less, 1.60 or less, 1.50 or less, 1.40 or less, or 1.30 or less, and is preferably 1.001 or more, preferably 1.005 or more, more preferably 1.01 or more, still more preferably 1.02 or more, and still much more preferably 1.03 or more.

That is to say, the molecular weight distribution (Mw/Mn) of the component (C) is preferably 1.001 to 8.00, more preferably 1.005 to 7.00, still more preferably 1.01 to 6.00, still much more preferably 1.02 to 3.00, and particularly preferably 1.03 to 2.00.

From the viewpoint of obtaining a lubricating oil composition having further improved shear stability, SSI (shear stability index) of the component (C) used in one embodiment of the present invention is preferably 60 or less, more preferably 40 or less, still more preferably 30 or less, still much more preferably 20 or less, and particularly preferably 15 or less.

The lower limit value of SSI of the component (C) is not particularly limited, but is usually 0.1 or more.

In the lubricating oil composition of one embodiment of the present invention, from the viewpoint of obtaining a lubricating oil composition having a further favorable effect of suppressing mist formation and shear stability, the content of the component (C) is preferably 0.10 to 2.00 mass %, more preferably 0.12 to 1.80 mass %, more preferably 0.15 to 1.70 mass %, still more preferably 0.17 to 1.50 mass %, still more preferably 0.20 to 1.20 mass %, still much more preferably 0.23 to 1.00 mass %, still much more preferably 0.25 to 0.80 mass %, and particularly preferably 0.27 to 0.50 mass %, based on the total amount (100 mass %) of the lubricating oil composition.

The component (C) used in one embodiment of the present invention is a copolymer having a structural unit derived from a monomer having an alkenyl group, and examples thereof include a copolymer of an α-olefin having 2 to 20 (preferably 2 to 16, more preferably 2 to 14) carbon atoms, and more specific examples thereof include an ethylene-α-olefin copolymer, a styrene-diene copolymer, and a styrene-isoprene copolymer.

In the lubricating oil composition of one embodiment of the present invention, from the viewpoint of obtaining a lubricating oil composition having a further favorable effect of suppressing mist formation and shear stability, the component (C) preferably contains a star-shaped polymer (C1).

In the lubricating oil composition of one embodiment of the present invention, the content ratio of the component (C1) in the component (C) is preferably 50 to 100 mass %, more preferably 70 to 100 mass %, still more preferably 80 to 100 mass %, still much more preferably 90 to 100 mass %, and particularly preferably 95 to 100 mass %, based on the total amount (100 mass %) of the component (C) contained in the lubricating oil composition.

The star-shaped polymer which is the component (C1) used in one embodiment of the present invention is only required to be a polymer having a structure in which three or more chain polymers are bonded at one point.

Examples of the chain polymer constituting the component (C1) include copolymers of a vinyl aromatic monomer and a conjugated diene monomer and hydrides thereof.

Examples of the vinyl aromatic monomer include styrenes, alkyl-substituted styrenes having 8 to 16 carbon atoms, alkoxy-substituted styrenes having 8 to 16 carbon atoms, vinyl naphthalenes, and alkyl-substituted vinyl naphthalenes having 8 to 16 carbon atoms.

Examples of the conjugated diene monomer include conjugated dienes having 4 to 12 carbon atoms, and specific examples thereof include 1,3-butadiene, isoprene, piperylene, 4-methylpenta-1,3-diene, 3,4-dimethyl-1,3-hexadiene, and 4,5-diethyl-1,3-octadiene.

<Viscosity Index Improver Other Than Components (B) and (C)>

The lubricating oil composition of one embodiment of the present invention may contain a viscosity index improver other than the components (B) and (C) as long as the effects of the present invention are not impaired.

However, the content of the viscosity index improver other than the components (B) and (C) is preferably 0 to 50 parts by mass, more preferably 0 to 30 parts by mass, still more preferably 0 to 10 parts by mass, and still much more preferably 0 to 1 part by mass, based on the total amount (100 parts by mass) of the components (B) and (C) contained in the lubricating oil composition.

From the viewpoint of obtaining a lubricating oil composition having a further favorable effect of suppressing mist formation and shear stability, the lubricating oil composition of one embodiment of the present invention preferably contains substantially no polymethacrylate-based viscosity index improver.

In the present specification, "containing substantially no polymethacrylate-based viscosity index improver" is a definition that excludes such an embodiment that a polymethacrylate-based viscosity index improver is compounded with a predetermined intention and contained in the lubricating oil composition. That is to say, it is not intended to exclude the case where the polymethacrylate-based viscosity index improver is inevitably mixed during the preparation of the lubricating oil composition, and such an embodiment that the components (B) and (C) are sheared and separated in a process of using the lubricating oil composition, and a part of these components corresponds to a polymer corresponding to the polymethacrylate-based viscosity index improver, thereby being contained in the lubricating oil composition.

Specific content of the polymethacrylate-based viscosity index improver is preferably less than 10 parts by mass, more preferably less than 5 parts by mass, still more preferably less than 1 part by mass, still much more preferably less than 0.1 parts by mass, and particularly preferably less than 0.01 parts by mass based on the total amount of the components (B) and (C) contained in the lubricating oil composition of 100 parts by mass.

In the present specification, the polymethacrylate-based viscosity index improver means a polymer having at least a structural unit derived from alkylmethacrylate that does not correspond to the components (B) and (C).

<Component (D): Ashless Dispersant>

The lubricating oil composition of one embodiment of the present invention preferably further contains an ashless dispersant (D). By containing an ashless dispersant that is the component (D), the additives contained in the lubricating oil composition can be uniformly dispersed, so that the performance of each additive can be effectively exhibited.

The component (D) may be used singly, or may be used in combination of two or more.

Examples of the component (D) used in one embodiment of the present invention include monosuccinimide, bis-succinimide, benzylamine, succinates, and boron-modified products thereof.

Among these, the component (D) used in one embodiment of the present invention preferably contains at least one selected from a succinimide and a boron-modified product of succinimide, and more preferably contains both a succinimide and a boron-modified product of succinimide.

The succinimide is preferably an alkenyl monosuccinimide represented by the following general formula (d-1) and an alkenyl bis-succinimide represented by the following general formula (d-2).

(d-1)

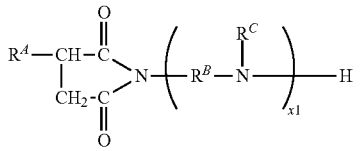

(d-2)

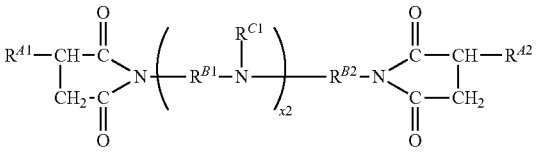

In the general formulae (d-1) and (d-2), $R^A$, $R^{A1}$ and $R^{A2}$ are each independently an alkenyl group having a mass-average molecular weight (Mw) of 500 to 3,000 (preferably 1,000 to 3,000). Examples of the alkenyl group include a polybutenyl group, a polyisobutenyl group and an ethylene-propylene copolymer, and among these, a polybutenyl group or a polyisobutenyl group is preferable.

$R^B$, $R^{B1}$ and $R^{B2}$ are each independently an alkylene group having 2 to 5 carbon atoms.

$R^C$ and $R^{C1}$ are each independently a hydrogen atom, an alkyl group having 1 to 10 carbon atoms, or a group represented by $-(AO)_n—H$ (wherein each A is independently an alkylene group having 2 to 4 carbon atoms, and n is an integer of 1 to 10).

x1 is an integer of 1 to 10, preferably an integer of 2 to 5, and more preferably 3 or 4.

x2 is an integer of 0 to 10, preferably an integer of 1 to 5, and more preferably an integer of 2 to 4.

From the viewpoint of obtaining a lubricating oil composition having favorable cleanliness and heat resistance, the component (D) used in the present invention preferably contains a non-boron-modified alkenyl succinimide.

For example, the boron-modified product of a succinimide used as the component (D) in one embodiment of the present invention is preferably at least one selected from a boron-modified product of an alkenyl monosuccinimide represented by the general formula (d-1) and a boron-modified product of an alkenyl bis-succinimide represented by the following general formula (b-2), and more preferably a boron-modified product of an alkenyl monosuccinimide represented by the following general formula (b-1).

In one embodiment of the present invention, the ratio [B/N] of boron atoms to nitrogen atoms constituting the boron-modified product of a succinimide is preferably 0.01 or more, more preferably 0.05 or more, still more preferably 0.1 or more, still much more preferably 0.2 or more, and particularly preferably 0.3 or more.

In one embodiment of the present invention, the content ratio [B/N] of boron atoms derived from the boron-modified product of a succinimide to nitrogen atoms derived from a succinimide (including both the non-boron-modified succinimide and the boron-modified product of a succinimide) by mass is preferably 0.01 to 0.60, more preferably 0.05 to 0.50, still more preferably 0.10 to 0.45, still much more preferably 0.15 to 0.40, and particularly preferably 0.20 to 0.35.

In the present specification, the content of boron atoms means a value measured in accordance with JPI-5S-38-2003.

In the lubricating oil composition used in one embodiment of the present invention, the content of the succinimide in terms of nitrogen atoms is preferably 0.005 to 0.30 mass %, more preferably 0.01 to 0.25 mass %, still more preferably 0.02 to 0.20 mass %, and still much more preferably 0.04 to 0.15 mass %, based on the total amount (100 mass %) of the lubricating oil composition.

In the present specification, the content of nitrogen atoms means a value measured in accordance with JIS K2609.

In the lubricating oil composition used in one embodiment of the present invention, the content of boron atoms derived from the boron-modified product of a succinimide is preferably 0.001 to 0.20 mass %, more preferably 0.005 to 0.15 mass %, still more preferably 0.01 to 0.10 mass %, and still much more preferably 0.015 to 0.05 mass %, based on the total amount (100 mass %) of the lubricating oil composition.

<Component (E): Metal-Based Detergent>

The lubricating oil composition of one embodiment of the present invention preferably further contains a metal-based detergent (E).

The component (E) may be used singly, or may be used in combination of two or more.

The component (E) used in one embodiment of the present invention is preferably one or more selected from a metal salicylate, a metal phenate, and a metal sulfonate each of which contains a metal atom selected from an alkali metal atom and an alkaline earth metal atom.

As the metal atom, sodium, calcium, magnesium, or barium is preferable, and calcium is more preferable. That is to say, the component (E) is preferably a calcium-based detergent.

As the metal sulfonate, a compound represented by the following general formula (e-1) is preferable, as the metal salicylate, a compound represented by the following general formula (e-2) is preferable, and as the metal phenate, a compound represented by the following general formula (e-3) is preferable.

(e-1)

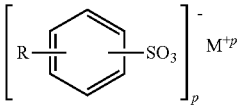

-continued (e-2)

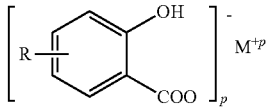

(e-3)

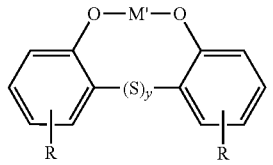

In the general formulae (e-1) and (e-2), M is a metal atom selected from alkali metals and alkaline earth metals; sodium, calcium, magnesium, or barium is preferable, and calcium is more preferable.

In the general formula (e-3), M' is an alkaline earth metal, calcium, magnesium, or barium is preferable, and calcium is more preferable. y is an integer of 0 or more, and preferably an integer of 0 to 3.

In the general formulae (e-1) to (e-3), p is a valence of M, and 1 or 2. R is a hydrogen atom or a hydrocarbon group having 1 to 18 carbon atoms.

Examples of the hydrocarbon groups capable of being selected as R include an alkyl group having 1 to 18 carbon atoms, an alkenyl group having 1 to 18 carbon atoms, a cycloalkyl group having 3 to 18 ring-forming carbon atoms, an aryl group having 6 to 18 ring-forming carbon atoms, an alkylaryl group having 7 to 18 carbon atoms, and an arylalkyl group having 7 to 18 carbon atoms.

The base number of the component (E) is preferably 0 to 600 mgKOH/g.

In the lubricating oil composition of one embodiment of the present invention, however, the component (B) preferably contains an overbased metal-based detergent having a base number of 100 mgKOH/g or more.

The base number of the overbased metal-based detergent is 100 mgKOH/g or more, but it is preferably 150 to 500 mgKOH/g, and more preferably 200 to 400 mgKOH/g.

In the present specification, the "base number" of the component (E) means a base number measured by "perchloric acid method" in accordance with JIS K2501 "Petroleum products and lubricants—Determination of neutralization number", 7.

In the lubricating oil composition of one embodiment of the present invention, the content of the component (E) in terms of metal atoms is preferably 100 to 6,000 mass ppm, more preferably 300 to 5,000 mass ppm, still more preferably 600 to 4,500 mass ppm, still much more preferably 1,000 to 4,000 mass ppm, and particularly preferably 1,500 to 3,500 mass ppm, based on the total amount (100 mass %) of the lubricating oil composition.

In the present specification, the content of metal atoms means a value measured in accordance with JPI-5S-38-2003.

<Component (F): antioxidant>

The lubricating oil composition used in one embodiment of the present invention preferably further contains an antioxidant (F). The component (F) may be used singly, or may be used in combination of two or more.

Examples of the component (F) used in one embodiment of the present invention include an amine-based antioxidant, a phenol-based antioxidant, a molybdenum-based antioxidant, a sulfur-based antioxidant and a phosphorous-based antioxidant.

Among these, the component (F) preferably contains one or more selected from an amine-based antioxidant and a phenol-based antioxidant, and more preferably contains both an amine-based antioxidant and a phenol-based antioxidant.

Examples of the amine-based antioxidant include diphenylamine-based antioxidants, such as diphenylamine, and alkylated diphenylamine including an alkyl group having 3 to 20 carbon atoms; and naphthylamine-based antioxidants, such as α-naphthylamine, phenyl-α-naphthylamine, and substituted phenyl-α-naphthylamine including an alkyl group having 3 to 20 carbon atoms.

Examples of the phenol-based antioxidant include monophenol-based antioxidants, such as 2,6-di-t-butylphenol, 2,6-di-t-butyl-4-methylphenol, 2,6-di-t-butyl-4-ethylphenol, C7-C9 alkyl-3-(3,5-di-t-butyl-4-hydroxyphenyl)propionate, isooctyl-3-(3,5-di-t-butyl-4-hydroxyphenyl)propionate and octadecyl-3-(3,5-di-t-butyl-4-hydroxyphenyl)propionate; diphenol-based antioxidants, such as 4,4'-methylenebis(2,6-di-t-butylphenol) and 2,2'-methylenebis(4-ethyl-6-t-butylphenol); and hindered phenol antioxidants.

In the lubricating oil composition used in one embodiment of the present invention, the content of the component (F) is preferably 0.01 to 6.0 mass %, more preferably 0.05 to 4.0 mass %, still more preferably 0.10 to 3.0 mass %, and still much more preferably 0.50 to 2.0 mass %, based on the total amount (100 mass %) of the lubricating oil composition.

<Component (G): Anti-Wear Agent>

The lubricating oil composition of one embodiment of the present invention preferably further contains an anti-wear agent (G).

The component (G) may be used singly, or may be used in combination of two or more.

Examples of the component (G) used in one embodiment of the present invention include sulfur-containing compounds, such as zinc dialkyldithiophosphate (ZnDTP), zinc phosphate, zinc dithiocarbamate, molybdenum dithiocarbamate, molybdenum dithiophosphate, disulfides, sulfurized olefins, sulfurized fats and oils, sulfurized esters, thiocarbonates, thiocarbamates, and polysulfides; phosphorus-containing compounds, such as phosphites, phosphates, phosphonates, and amine salts or metal salts thereof; sulfur- and phosphorus-containing anti-wear agents, such as thiophosphites, thiophosphates, thiophosphonates, and amine salts or metal salts thereof.

Among these, zinc dialkyldithiophosphate (ZnDTP) is preferably contained as the component (G). Examples of zinc dialkyldithiophosphate include the compound represented by the following general formula (g–1).

(g-1)

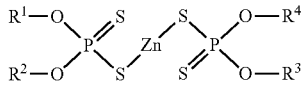

In the above formula (g–1), $R^1$ to $R^4$ each independently represents a hydrocarbon group, and may be the same as one another or may be different from one another.

The number of carbon atoms of the hydrocarbon group capable of being selected as $R^1$ to $R^4$ is preferably 1 to 20, more preferably 1 to 16, still more preferably 3 to 12, and still much more preferably 3 to 10.

Specific examples of the hydrocarbon groups capable of being selected as $R^1$ to $R^4$ include alkyl groups, such as a methyl group, an ethyl group, a propyl group, a butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group and an octadecyl group; alkenyl groups, such as an octenyl group, a nonenyl group, a decenyl group, an undecenyl group, a dodecenyl group, a tridecenyl group, a tetradecenyl group and a pentadecenyl group; cycloalkyl groups, such as a cyclohexyl group, a dimethylcyclohexyl group, an ethylcyclohexyl group, a methylcyclohexylmethyl group, a cyclohexylethyl group, a propylcyclohexyl group, a butylcyclohexyl group and a heptylcyclohexyl group; aryl groups, such as a phenyl group, a naphthyl group, an anthracenyl group, a biphenyl group and a terphenyl group; alkylaryl groups, such as a tolyl group, a dimethylphenyl group, a butylphenyl group, a nonylphenyl group, a methylbenzyl group and a dimethylnaphthyl group; and arylalkyl groups, such as a phenylmethyl group, a phenylethyl group and a diphenylmethyl group.

Among these, preferable are alkyl groups, and more preferable are primary or secondary alkyl groups, as the hydrocarbon groups capable of being selected as $R^1$— to $R^4$.

In the lubricating oil composition of one embodiment of the present invention, the content of the component (G) is preferably 0.01 to 15.0 mass %, more preferably 0.05 to 12.0 mass %, still more preferably 0.10 to 10.0 mass %, and still much more preferably 0.20 to 8.0 mass %, based on the total amount (100 mass %) of the lubricating oil composition.

When zinc dialkyldithiophosphate (ZnDTP) is contained as the component (G) in the lubricating oil composition of one embodiment of the present invention, the content of ZnDTP in terms of zinc atoms is preferably 0.01 to 1.0 mass %, more preferably 0.03 to 0.80 mass %, still more preferably 0.05 to 0.60 mass %, still much more preferably 0.08 to 0.50 mass %, and particularly preferably 0.10 to 0.40 mass %, based on the total amount (100 mass %) of the lubricating oil composition.

The content of ZnDTP in terms of phosphorus atoms is preferably 0.01 to 1.0 mass %, more preferably 0.02 to 0.70 mass %, still more preferably 0.03 to 0.50 mass %, still much more preferably 0.05 to 0.40 mass %, and particularly preferably 0.07 to 0.30 mass %, based on the total amount (100 mass %) of the lubricating oil composition.

In the present specification, the content of zinc atoms and phosphorus atoms means a value measured in accordance with JPI-5S-38-2003.

<Lubricating Oil Additives>

The lubricating oil composition of one embodiment of the present invention may further contain lubricating oil additives other than the components (B) to (G) when needed as long as the effects of the present invention are not impaired.

Examples of such lubricating oil additives include a pour point depressant, a demulsifier, a friction modifier, a corrosion inhibitor, a metal deactivator, an anticorrosive, an antistatic, and an anti-foaming agent.

These lubricating oil additives may be each used singly, or may be each used in combination of two or more.

The contents of these lubricating oil additives can be each appropriately adjusted as long as the effects of the present invention are not impaired, but the contents of the additives are each independently usually 0.001 to 15 mass %, preferably 0.005 to 10 mass %, and more preferably 0.01 to 5 mass %, based on the total amount (100 mass %) of the lubricating oil composition.

<Production Method for Lubricating Oil Composition>

The production method for the lubricating oil composition of one embodiment of the present invention is not particularly limited, but from the viewpoint of productivity, preferable is a method having a step of compounding the components (B) and (C), and if necessary, the components (D) to (G) and other lubricating oil additives with the component (A).

From the viewpoint of compatibility with the component (A), the components (B) and (C) are preferably in a form of a solution dissolved in a diluent oil and the solution is preferably compounded with the component (A).

[Characteristics of Lubricating Oil Composition]

The SAE viscosity grade of the lubricating oil composition of one embodiment of the present invention is preferably 0W-30 or 5W-30. In these SAE viscosity grades, the lubricating oil composition can sufficiently exhibit various performance such as the effect of suppressing mist formation, shear stability, and fuel-saving performance.

The lubricating oil composition of one embodiment of the present invention preferably satisfies the following requirements (I) and (II).

Requirement (I): the 100° C. kinematic viscosity of the lubricating oil composition after being subjected to ultrasonic irradiation for 30 minutes in accordance with the low output method of JPI-5S-29 is 9.3 $mm^2/s$ or more.

Requirement (II): when a degraded oil obtained by degrading the lubricating oil composition based on the method described in Examples described below is mixed with compressed air to be formed into mist and the amount of oil mist (mist mass) is measured, the mist formation rate calculated by the following expression is less than 2.00%.

$$[\text{mist formation rate}](\%)=[\text{mist mass}]/[\text{degraded oil mass}]\times 100$$

The requirement (I) defines the shear stability of the lubricating oil composition.

The 100° C. kinematic viscosity defined in the requirement (I) is 9.3 $mm^2/s$ or more, and is preferably 9.35 $mm^2/s$ or more, more preferably 9.4 $mm^2/s$ or more, still more preferably 9.5 $mm^2/s$ or more, still much more preferably 9.6 $mm^2/s$ or more, and particularly preferably 9.7 $mm^2/s$ or more.

The 100° C. kinematic viscosity defined in the requirement (I) is a value obtained by preparing a lubricating oil composition by the method described in Examples described below and calculating the lubricating oil composition under the measurement conditions described in Examples.

The requirement (II) defines the effect of suppressing mist formation of the lubricating oil composition.

The mist formation rate defined in the requirement (II) is less than 2.00%, and is preferably 1.98% or less, more preferably 1.95% or less, still more preferably 1.80% or less, still much more preferably 1.50% or less, and particularly preferably 1.30% or less.

The mist formation rate defined in the requirement (II) is a value obtained by preparing a lubricating oil composition by the method described in Examples described below and calculating the lubricating oil composition under the measurement conditions described in Examples.

[Use Application of Lubricating Oil Composition]

As described above, the lubricating oil composition of one embodiment of the present invention is excellent in various performance such as the effect of suppressing mist formation, shear stability, and fuel-saving performance.

On that account, the lubricating oil composition of one embodiment of the present invention is preferably used for lubrication of an internal combustion engine, such as a diesel engine and a gas engine, and in particular, more preferably used for lubrication of a diesel engine.

When the aforementioned characteristics of the lubricating oil composition of one embodiment of the present invention are taken into consideration, the present invention can also provide the following [1] and [2].

[1] An internal combustion engine applied with the aforementioned lubricating oil composition of one embodiment of the present invention.

[2] A method for using the lubricating oil composition, wherein the aforementioned lubricating oil composition of one embodiment of the present invention is applied to lubrication of an internal combustion engine.

EXAMPLES

Next, the present invention will be described in much more detail with reference to Examples, but the present invention is in no way limited to these Examples. Measuring methods and evaluation methods for various properties are as follows.

(1) Kinematic Viscosity, Viscosity Index

The kinematic viscosity and viscosity index were measured and calculated in accordance with JIS K2283:2000.

(2) Weight Average Molecular Weight (Mw), Number Average Molecular Weight (Mn), the Molecular Weight Distribution (Mw/Mn)

Using a gel permeation chromatograph apparatus (manufactured by Agilent Technologies, Inc., "1260 model HPLC"), the weight average molecular weight was measured under the following conditions, and a value measured in terms of standard polystyrene was used.

(Measurement Conditions)

Column: sequentially connected two of "Shodex LF404".

Column temperature: 35° C.

Developing solvent: chloroform

Flow rate: 0.3 mL/min

The ratio [Mw/Mn] of the measured weight average molecular weight (Mw) to the number average molecular weight (Mn) was calculated as the molecular weight distribution.

(3) SSI (Shear Stability Index)

A mineral oil serving as the diluent oil was added to a polymer serving as the measurement object to prepare a sample oil, and by using the sample oil and the mineral oil, SSI was measured in accordance with JPI-5S-29-06.

Specifically, each value of $Kv_0$, $Kv_1$, and $K_{voil}$ in the expression (1) was measured for a polymer serving as the object, and then SSI was calculated by the expression (1).

(4) Contents of Boron Atoms, Calcium Atoms, Zinc Atoms, and Phosphorus Atoms

The contents were measured in accordance with JPI-5S-38-2003.

(5) Content of Nitrogen Atoms

The contents were measured in accordance with JIS K2609.

(6) Base Number

The base number was measured in accordance with the perchloric acid method of JIS K2501:2003.

Examples 1 to 4 and Comparative Examples 1 to 6

Each additive was compounded with the base oil in the types and compounding amounts shown in Tables 1 and 2, thereby preparing each lubricating oil composition. The compounding amount of the comb-shaped polymer, star-shaped polymer, and PMA compounded as polymers as described in Tables 1 and 2 is, when the polymers were compounded in a state being dissolved in a diluent oil, the compounding amount in terms of active ingredients (in terms of solid content (resin content)) from which the mass of the diluent oil was excluded.

Here, details of the base oil and each additive used for preparation of each lubricating oil composition are as follows.

<Base Oil>

100N mineral oil: paraffinic mineral oil classified in Group III of API base oil categories, 40° C. kinematic viscosity=18.4 $mm^2/s$, 100° C. kinematic viscosity=4.1 $mm^2/s$, viscosity index=125.

<Polymer Component>

Comb-shaped polymer (1): comb-shaped polymer, Mw=600,000, Mw/Mn=2.4, SSI=49.

Comb-shaped polymer (2): comb-shaped polymer, Mw=370,000, Mw/Mn=5.2, SSI=35.

Star-shaped polymer (1): star-shaped polymer, Mw=580,000, Mw/Mn=1.1, SSI=14.

Star-shaped polymer (2): star-shaped polymer, Mw=620,000, Mw/Mn=1.2, SSI=17.

Star-shaped polymer (3): star-shaped polymer, Mw=450,000, Mw/Mn=1.1, SSI=6.

PMA: polyalkyl methacrylate, Mw=400,000, Mw/Mn=1.7, SSI=56.

<Various Additives>

Boron-modified succinimide: boron-modified succinimide, boron atom (B) content=0.49 mass %, nitrogen atom (N) content=1.5 mass %, B/N=0.33.

Non-boron-modified succinimide: non-boron-modified succinimide, nitrogen atom (N) content=1.0 mass %.

Metal-based detergent: overbased calcium salicylate of base number=226 mgKOH/g, calcium atom (Ca) content=8.1 mass %.

Amine-based antioxidant: 4,4'-dinonylphenylamine

Phenol-based antioxidant: C7-C9 alkyl-3-(3,5-di-t-butyl-4-hydroxyphenyl) propionate ZnDTP: secondary zinc alkyldithiophosphate, zinc atom (Zn) content=8.3 mass %, phosphorus atom (P) content=7.0 mass %

Other additives: mixed additives of friction modifier, pour point depressant, anti-foaming agent, and metal deactivator.

Regarding the lubricating oil composition prepared, the 40° C. kinematic viscosity, 100° C. kinematic viscosity, and viscosity index were measured or calculated in accordance with the aforementioned method, and the following measurements of characteristics were carried out. The results of them are set forth in Tables 1 and 2.

(1) Measurement of Kinematic Viscosity after Ultrasonic Irradiation by Low Output Method The 40° C. kinematic viscosity and 100° C. kinematic viscosity of the lubricating oil composition after being subjected to ultrasonic irradiation for 30 minutes in accordance with the low output method of JPI-5S-29 were measured. When the 100° C. kinematic viscosity of the lubricating oil composition after being subjected to ultrasonic irradiation is 9.3 $mm^2/s$ or more, it is deemed that the lubricating oil composition is excellent in shear stability.

(2) Measurement of Mist Formation Rate 100 g of the lubricating oil composition prepared was put in a glass tube, and a blowing pipe having an outer diameter of 7.0 mm was inserted so as to be immersed in the lubricating oil composition in the glass tube. Then, the oil temperature was heated to 140° C., and NO gas and air were each blown through the blowing pipe at a flow rate of 6 L/h for 24 hours. Then, the lubricating oil composition after blowing of NO gas was subjected to ultrasonic irradiation for 30 minutes in accordance with the low output method of JPI-5S-29, thereby adjusting the degraded oil.

Using 40 g of the thus adjusted degraded oil (=degraded oil mass), the degraded oil was mixed with compressed air to be formed into mist, the amount of oil mist (=mist mass) was then measured, and the mist formation rate was calculated by the following expression. It is deemed that, as the value of the mist formation rate is lower, the lubricating oil composition has a higher effect of suppressing mist formation.

$$[\text{mist formation rate}](\%)=[\text{mist mass}]/[\text{degraded oil mass}]\times 100$$

The test apparatus and test conditions used to form the degraded oil into mist were as follows.

Test apparatus: TACO mist measurement apparatus (model number: C3-0807, manufactured by Azbil TA Co., Ltd.)

Air pressure: 0.2 MPa

Amount of sample oil (degraded oil mass): 40 g

TABLE 1

| | | | | Example 1 | Example 2 | Example 3 | Example 4 |
|---|---|---|---|---|---|---|---|
| Composition of lubricating oil composition | Base oil | 100N mineral oil | mass % | 75.05 | 72.70 | 73.40 | 71.80 |
| | Polymer | Comb-shaped polymer (1) Mw = 600,000 | mass % | — | — | 1.54 | 1.32 |
| | | Comb-shaped polymer (2) Mw = 370,000 | mass % | 0.90 | 1.42 | — | — |
| | | Star-shaped polymer (1) Mw = 580,000 | mass % | — | — | 0.35 | — |
| | | Star-shaped polymer (2) Mw = 620,000 | mass % | 0.76 | 0.61 | — | 0.61 |
| | | Star-shaped polymer (3) Mw = 450,000 | mass % | — | — | — | — |
| | | PMA Mw = 400,000 | mass % | — | — | — | — |
| | Various additives | Boron-modified succinimide | mass % | 5.50 | 5.50 | 5.50 | 5.50 |
| | | Non-boron-modified succinimide | mass % | 2.75 | 2.75 | 2.75 | 2.75 |
| | | Metal-based detergent | mass % | 2.75 | 2.75 | 2.75 | 2.75 |
| | | Amine-based antioxidant | mass % | 0.50 | 0.50 | 0.50 | 0.50 |
| | | Phenol-based antioxidant | mass % | 1.00 | 1.00 | 1.00 | 1.00 |

TABLE 1-continued

| | | | | Example 1 | Example 2 | Example 3 | Example 4 |
|---|---|---|---|---|---|---|---|
| | | ZnDTP | mass % | 1.39 | 1.39 | 1.39 | 1.39 |
| | | Other additives | mass % | 9.40 | 11.38 | 10.82 | 12.38 |
| | | Total | mass % | 100.00 | 100.00 | 100.00 | 100.00 |
| | | Star-shaped polymer/comb-shaped polymer (mass ratio) | — | 0.84 | 0.43 | 0.23 | 0.46 |
| | | Total content of star-shaped polymer and comb-shaped polymer | mass % | 1.66 | 2.03 | 1.89 | 1.93 |
| Various properties | | 40° C. kinematic viscosity of lubricating oil composition | $mm^2/s$ | 52.2 | 49.2 | 50.2 | 48.9 |
| | | 100° C. kinematic viscosity of lubricating oil composition | $mm^2/s$ | 11.0 | 10.7 | 10.8 | 10.7 |
| | | Viscosity index of lubricating oil composition | — | 208 | 215 | 214 | 217 |
| | Kinematic viscosity after being subjected to ultrasonic irradiation | 40° C. kinematic viscosity | $mm^2/s$ | 48.8 | 46.5 | 48.4 | 46.3 |
| | | 100° C. kinematic viscosity | $mm^2/s$ | 9.8 | 9.6 | 9.7 | 9.4 |
| | | Mist formation rate | % | 1.71 | 1.95 | 1.24 | 1.86 |

TABLE 2

| | | | | Comparative Example 1 | Comparative Example 2 | Comparative Example 3 | Comparative Example 4 | Comparative Example 5 |
|---|---|---|---|---|---|---|---|---|
| Composition of lubricating oil composition | Base oil | 100N mineral oil | mass % | 72.90 | 78.54 | 79.50 | 73.30 | 74.30 |
| | Polymer | Comb-shaped polymer (1) Mw = 600,000 | mass % | 2.32 | — | — | 0.80 | 1.54 |
| | | Comb-shaped polymer (2) Mw = 370,000 | mass % | — | — | — | — | — |
| | | Star-shaped polymer (1) Mw = 580,000 | mass % | — | — | — | — | — |
| | | Star-shaped polymer (2) Mw = 620,000 | mass % | — | 0.34 | 0.34 | 0.61 | — |
| | | Star-shaped polymer (3) Mw = 450,000 | mass % | — | — | — | — | 0.49 |
| | | PMA Mw = 400,000 | mass % | — | 1.27 | 1.68 | — | — |
| | Various additives | Boron-modified succinimide | mass % | 5.50 | 5.50 | 5.50 | 5.50 | 5.50 |
| | | Non-boron-modified succinimide | mass % | 2.75 | 2.75 | 2.75 | 2.75 | 2.75 |
| | | Metal-based detergent | mass % | 2.75 | 2.75 | 2.75 | 2.75 | 2.75 |
| | | Amine-based antioxidant | mass % | 0.50 | 0.50 | 0.50 | 0.50 | 0.50 |
| | | Phenol-based antioxidant | mass % | 1.00 | 1.00 | 1.00 | 1.00 | 1.00 |
| | | ZnDTP | mass % | 1.39 | 1.39 | 1.39 | 1.39 | 1.39 |
| | | Other additives | mass % | 10.89 | 5.96 | 4.59 | 11.40 | 9.78 |
| | | Total | mass % | 100.00 | 100.00 | 100.00 | 100.00 | 100.00 |
| | | Star-shaped polymer/comb-shaped polymer (mass ratio) | — | 0.00 | — | — | 0.76 | 0.32 |
| | | Total content of star-shaped polymer and comb-shaped polymer | mass % | 2.32 | 0.34 | 0.34 | 1.41 | 2.03 |
| Various properties | | 40° C. kinematic viscosity of lubricating oil composition | $mm^2/s$ | 42.2 | 56.5 | 49.0 | 42.2 | 50.8 |
| | | 100° C. kinematic viscosity of lubricating oil composition | $mm^2/s$ | 10.2 | 11.2 | 10.7 | 8.3 | 11.0 |
| | | Viscosity index of lubricating oil composition | — | 242 | 195 | 215 | 177 | 214 |
| | Kinematic viscosity after being subjected to ultrasonic irradiation | 40° C. kinematic viscosity | $mm^2/s$ | 42.0 | 45.2 | 42.4 | 42.1 | 49.9 |
| | | 100° C. kinematic viscosity | $mm^2/s$ | 9.2 | 9.0 | 8.8 | 8.0 | 10.0 |
| | | Mist formation rate | % | 1.62 | 2.07 | 3.29 | 2.07 | 2.89 |

As shown in Table 1, the lubricating oil compositions prepared in Examples 1 to 4 resulted in having a low viscosity and also having an excellent effect of suppressing mist formation and excellent shear stability. Thus, the lubricating oil compositions prepared in Examples 1 to 4 are preferably applicable to lubrication of the internal combustion engine (in particular, diesel engine).

In contrast, as shown in Table 2, the lubricating oil composition prepared in Comparative Example 1 resulted in having a favorable effect of suppressing mist formation, but poor shear stability. Moreover, each of the lubricating oil compositions prepared in Comparative Examples 2 to 5 resulted in having an insufficient effect of suppressing mist formation, and further, each of the lubricating oil compositions of Comparative Examples 2 to 4 resulted in also having poor shear stability.

The invention claimed is:

1. A lubricating oil composition, comprising, based on total lubricating oil composition mass:

a base oil (A) in a range of from 70 to 95 mass %;

a comb-shaped polymer (B) in more than 0.80 mass %, the comb-shaped polymer (B) comprising a side chain of the macromonomer (x1) having a content of a structural unit (X1) derived from the macromonomer (x1) of 0.5 mol % or more of structural units of the comb-shaped polymer (B); and an olefin-based copolymer (C) comprising a star-shaped polymer (C1) in a range of from 0.10 to 1.50 mass %, wherein a total (B) and (C) content of the comb-shaped polymer (B) and the olefin-based copolymer (C) is less than 2.32 mass %, wherein a (C)/(B) mass ratio of the olefin-based copolymer (C) to the comb-shaped polymer (B) is in a range of from 0.05 to 0.90, wherein the comb-shaped polymer (B) has a weight average molecular weight in a range of from 350,000 to 900,000, wherein the olefin-based copolymer (C) has a weight average molecular weight in a range of from 500,000 to 900,000, wherein the lubricating oil composition has a viscosity index in a range of from 200 to less than 242, and wherein the lubricating oil composition has a kinematic viscosity at 100° C. in a range of from 9.3 to 11.0 $mm^2/s$.

2. The composition of claim 1, wherein the (C)/(B) content ratio is in a range of from 0.1 to 0.85.

3. The composition of claim 1, wherein the weight average molecular weight of the comb-shaped polymer (B) is in a range of from 450,000 to 800,000.

4. The composition of claim 1, wherein the olefin-based copolymer (C) is present in a range of from 0.17 to 1.20 mass %, based on the total lubricating oil composition mass.

5. The composition of claim 1, wherein the olefin-based copolymer (C) consists of a star-shaped polymer (C1).

6. The composition of claim 1, wherein the total (B) and (C) content is in a range of from 0.90 to 2.03 mass %, based on the total lubricating oil composition mass.

7. The composition of claim 1, further comprising:

an ashless dispersant (D) comprising a succinimide and/or a boron-modified product of succinimide.

8. The composition of claim 1, further comprising:

a polymethacrylate-based viscosity index improver in less than 10 parts by mass, based on a total mass of the comb-shaped polymer (B) and olefin-based copolymer (C) being 100 parts by mass.

9. The composition of claim 1, having an SAE viscosity grade of 0W-30 or 5W-30.

10. The composition of claim 1, having a 100° C. kinematic viscosity, after being subjected to ultrasonic irradiation for 30 minutes in accordance with a low output method of JPI-5S-29, of 9.3 $mm^2/s$ or more.

11. The composition of claim 1, which is suitable for lubrication of an internal combustion engine.

12. An internal combustion engine, comprising:

the lubricating oil composition of claim 1.

13. A method for lubricating an internal combustion engine, the method comprising:

contacting the lubricating oil composition of claim 1 and an internal combustion engine to thereby lubricate of the internal combustion engine.

14. The composition of claim 1, further comprising:

a succinimide (D1) and a boron-modified product of succinimide (D2).

15. The composition of claim 1, wherein the total (B) and (C) content is in a range of from 1.10 to 2.03 mass %, based on the total lubricating oil composition mass.

16. The composition of claim 1, wherein the structural unit (X1) the comb-shaped polymer (B) is in a range of from 0.5 to 20 mol. %.

17. The composition of claim 1, wherein the structural unit (X1) is in a range of from 0.7 to 10 mol. %.

18. The composition of claim 1, wherein the structural unit (X1) is in a range of from 0.9 to 5 mol. %.

19. The composition of claim 1, wherein the structural unit (X1) comprises, as structural unit:

(i)

$$-(R^{b1})-,$$

(ii)

$$-(R^{b2}O)-,$$ and/or (iii)

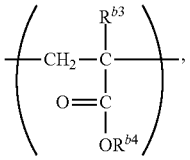

wherein $R^{b1}$ is independently a linear or branched alkylene group having 1 to 10 carbon atoms, $R^{b2}$ is independently a linear or branched alkylene group having 2 to 4 carbon atoms, $R^{b3}$ is independently a H or a methyl group, and $R^{b4}$ is independently a linear or branched alkyl group having 1 to 10 carbon atoms.

20. The composition of claim 1, wherein the star-shaped polymer (C1) comprises a copolymer of a vinyl aromatic monomer and a conjugated diene monomer having 4 to 12 carbon atoms, and wherein the vinyl aromatic monomer is a styrene, alkyl-substituted styrene having 8 to 16 carbon atoms, alkoxy-substituted styrene having 8 to 16 carbon atoms, vinyl naphthalene, or alkyl-substituted vinyl naphthalene having 8 to 16 carbon atoms.

* * * * *